United States Patent [19]

Carroll

[11] 4,241,668

[45] Dec. 30, 1980

[54] SUPPLY CONTAINER MOUNTING

[76] Inventor: Wilfred J. Carroll, 511 The West Mall, Apt. 410, Etobicoke, Ontario, Canada, M9C 1G5

[21] Appl. No.: 966,143

[22] Filed: Dec. 4, 1978

[51] Int. Cl.[3] ..... A47B 85/00

[52] U.S. Cl. ..... 108/26; 312/270

[58] Field of Search ..... 108/26, 134; 211/71, 211/126, 184; 248/311.1 A; 312/270

[56] References Cited

U.S. PATENT DOCUMENTS

| | | | |
|---|---|---|---|
| 2,237,820 | 4/1941 | Hill | 312/270 X |
| 2,242,903 | 5/1941 | Crimmel | 108/26 |
| 3,021,185 | 2/1962 | Kowalczyk | 108/26 X |
| 3,108,455 | 10/1963 | Hanson | 312/270 UX |
| 3,266,858 | 8/1966 | Klotz | 312/270 |
| 3,331,646 | 7/1967 | Peters | 312/270 |
| 3,519,319 | 7/1970 | Taylor | 312/270 X |
| 3,874,552 | 4/1975 | Grimm | 312/270 |

*Primary Examiner*—Roy D. Frazier
*Assistant Examiner*—Peter A. Aschenbrenner
*Attorney, Agent, or Firm*—Alan Swabey; Robert E. Mitchell; Guy J. Houle

[57] ABSTRACT

A readily dismountable frame for mounting a container and cover under a supply shelf. The frame is suspended between spaced-apart rails depending from the shelf. One end of the frame is provided with fixed hooks to engage a first rail and the other with retractable spring-loaded catches which engage a second rail spaced from the first. Side beams on the frame have inwardly extending flanges for engaging under the flange of the tote box and cover permitting them to be slid into place separately or to be removed for filling or cleaning. Adjustable connectors between the beams permit width-wise adjustment for different sized containers. The device is specially applicable to suspending tote boxes and covers from wire supply carts.

15 Claims, 4 Drawing Figures

SUPPLY CONTAINER MOUNTING

BACKGROUND OF THE INVENTION

1. Field of the Invention

This invention relates to a device for mounting a container and cover from a supply shelf, specially of a wire supply cart or the like.

2. Description of the Prior Art

Supply carts, particularly those made of wire, are widely used in hospitals and other institutions to contain supplies and for moving them from a supply room to different stations. A typical cart is shown, for example, in U.S. Pat. No. 3,977,334, Carroll, Aug. 31, 1976. Such a cart is made up of several horizontal elongated vertically spaced wire shelves mounted at each end corner on an upright frame member which, in turn, is carried by floor wheels pivotally mounted for the movement of the cart in any horizontal direction. The shelves which are used for holding supplies, also provide convenient supports from which to suspend tote boxes for carrying additional supplies.

A conventional arrangement is to bolt to the shelf a plate provided with side channels to receive the flanges of a tote box. The plate also serves as a cover for the tote box. Such an arrangement, while effective for carrying supplies, becomes essentially a permanent part of the frame. It collects dirt and access to it through the wire shelf for cleaning is difficult. Its removal for cleaning or otherwise is cumbersome and time-consuming.

SUMMARY OF THE INVENTION

It is an aim of the invention to provide an improved structure which avoids these disadvantages and provides certain positive advantages.

In accordance with the invention, a mounting device is provided for mounting a container and cover on a super-structure having substantially horizontal spaced-apart supporting members, which is made up of a open frame for suspending between the supporting members by carrying members resting on them. The carrying members at, at least, one end of the frame are retractable so that the frame can be lifted into place and removed from below. The frame has side engaging members, preferably flanges, for engaging side flanges on a tote box and for engaging the cover separately. Desirably, the frame is adjustable so that the spacing between the side members can be varied for tote boxes and covers of different widths.

In a preferred construction, the side members take the form of beams provided with inwardly extending flanges for supporting the flanges of a tote box and separate flanges for engaging the margins of a cover. Connectors extend between the side beams and are preferably adjustable to permit variation of the spacing between the side beams to accommodate tote boxes and covers of different widths. Each beam carries at one end a fixed hook member for hooking over a horizontal rail depending from a shelf and at the other end a spring-loaded catch member which can be retracted to allow lifting of the frame from below to between a first horizontal rail, usually of a truss depending from a supply shelf, and a second horizontal rail spaced from it and the catch member then released to engage the top of the second rail. Desirably, the respective catch members are linked by a cross rod to facilitate their retraction in unison.

BRIEF DESCRIPTION OF THE DRAWINGS

Having thus generally described the invention, it will be referred to in more detail by reference to the accompanying drawings illustrating a preferred embodiment, and in which.

DESCRIPTION OF THE PREFERRED EMBODIMENTS

Figure 1:
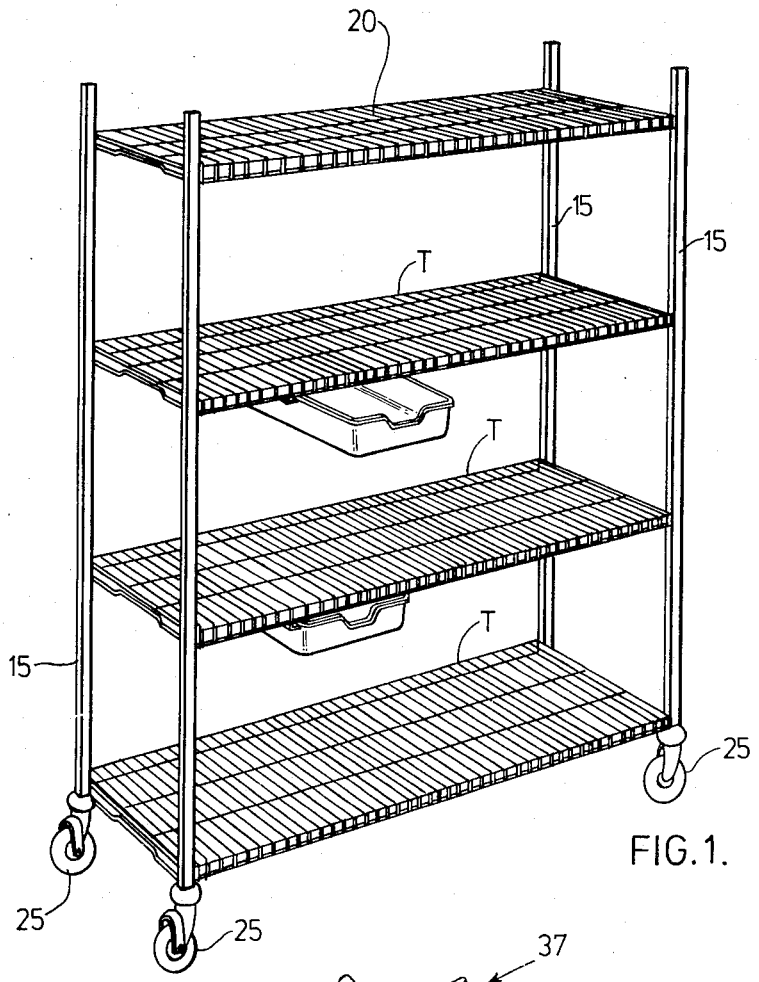
FIG. 1 is a perspective view of a wire cart showing tote trays suspended from its shelves.
Figure 2:
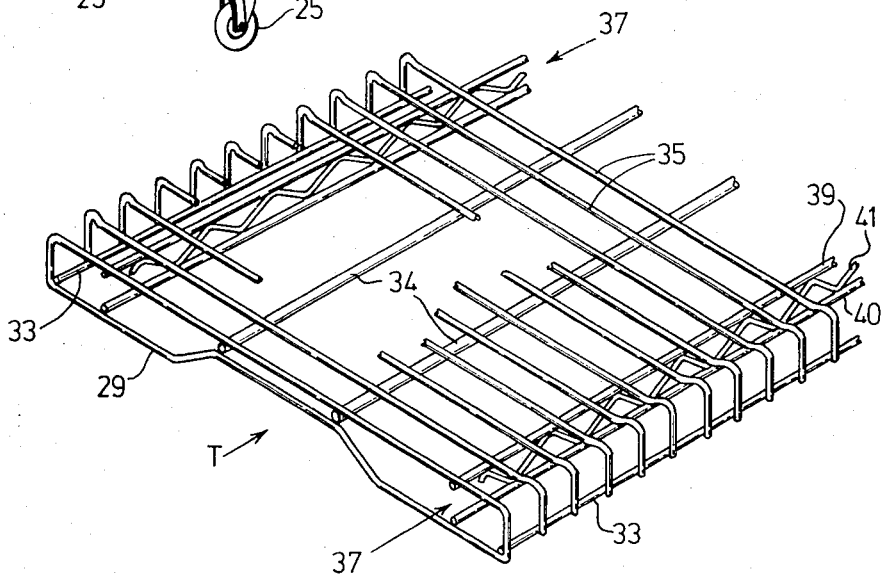
FIG. 2 is an enlarged fragmentary view showing the shelf construction with spaced-apart frame supporting trusses.
Figure 3:
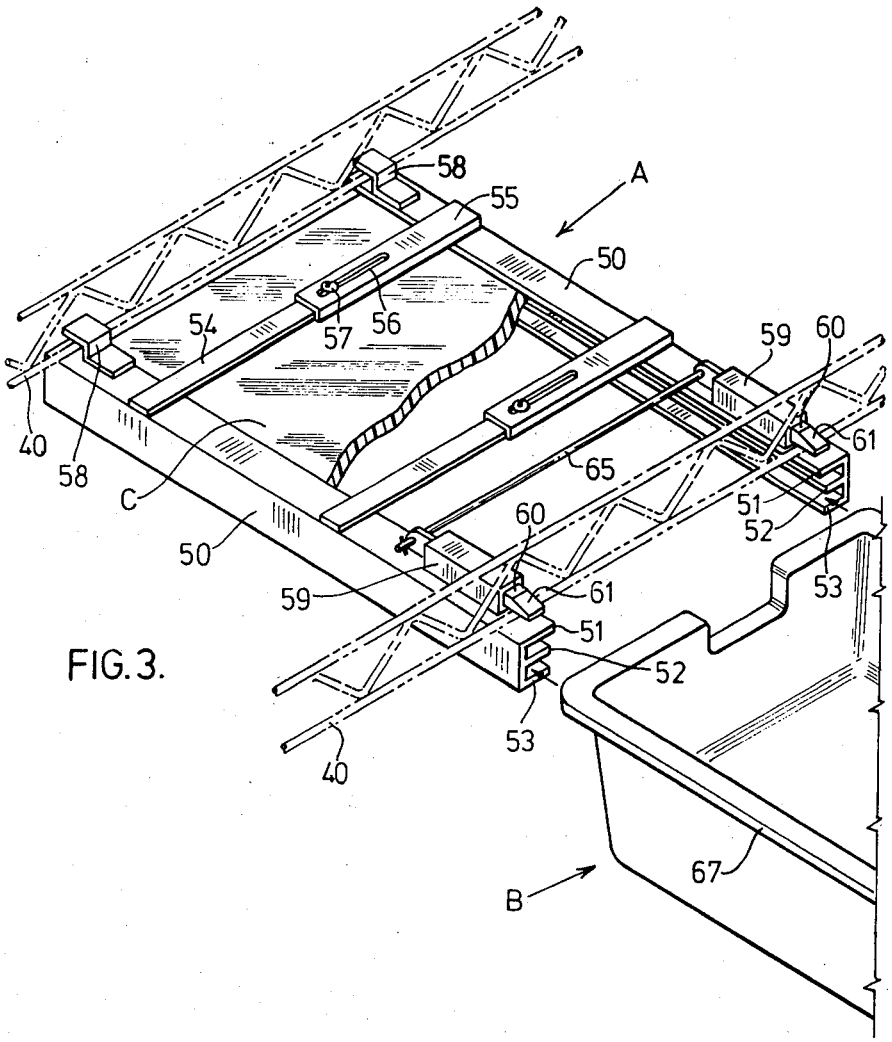
FIG. 3 is a further enlarged perspective view showing the tote box suspending frame in position relative to spaced-apart trusses on a shelf and showing the tote box about to be put in place.
Figure 4:
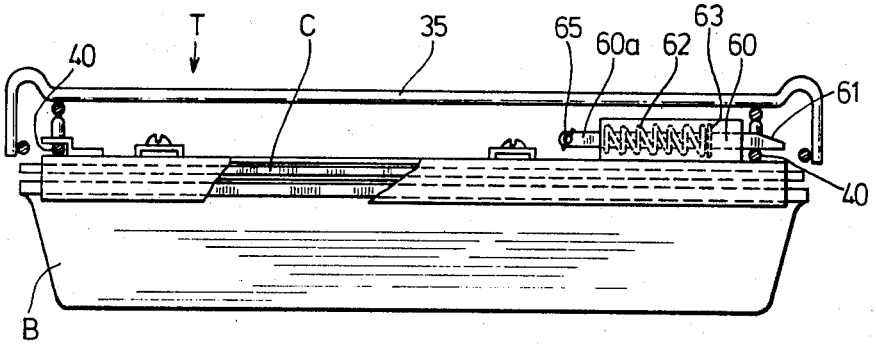
FIG. 4 is an end elevation, partly in section, showing the suspended tote box and cover.

More specific reference will now be made to the drawings. FIG. 1 shows a supply cart made up of a frame of uprights 15 supporting the corners of horizontal elongated wire trays or shelves T. The lower end of the uprights are mounted on universally pivotable floor wheels 25.

The shelf T is made up of end trusses 29 connected by longitudinally extending border wires 33. Intervening spaced-apart cross wires 35 are hooked downward at each end to terminate by connection to the border wires 33. Intermediate longitudinal connecting wires 34 extend between the trusses 29 and are also connected to the intermediate wires 35.

Spaced inward from the side of the shelf T are spaced-apart longitudinal trusses 37 each made up of an upper wire rail 39 and a lower wire rail 40 intervened by a zig-zag connecting wire 41. The upper rail 39 is connected to the trusses 29 and the wires 33. The lower rail 40 is connected to the trusses 29.

In accordance with the invention, a suspending frame A for a tote box B is provided for suspension from a shelf T. This frame A is made up of side beams 50 each provided with inwardly extending upper, intermediate and lower flanges 51, 52 and 53 respectively. The beams 50 are connected by spaced-apart connectors each made up of a strap in the form of a bar 54 extending inward from one beam 50 and a strap in the form of a channel 55 extending inward from the other beam 50 into which the bar 54 slides. The channel 55 is provided with a slot 56 accommodating a set screw 57 screwed into a tapped hole (not shown) in the bar 54.

Mounted on each flange 51, near one end, is a hook member 58 in the form of a stepped metal plate. Mounted on the other end of each flange 51 is an elongated tubular housing 59 of rectangular cross-section. Slidable in the housing 59 is a retractable plunger 60 terminating at one end in a bevel 61 and at the other end having a shank **60*a*. A coil spring 62 surrounding the shank 60*a* acting between a rear wall on the housing 59 and the plunger 60 to which it is connected urges the plunger in the outward direction. The other end of the shank 60*a*, outside the housing, has an opening receiving a rod 65 which extends between the respective plungers 60, linking them together for common movement. Alternatively, each end of the rod 65 may be provided with a tapped opening to receive a screw which extends through the opening in the shank 60*a*. In this case the opening in the shank 60*a* is just big enough to pass the screw and the end of the rod 65 abuts the shank 60***a*.

The supporting frame A and the tote box B and its cover C are mounted on the shelf as follows.

The beams 50 are spaced-apart through the adjustable connectors so that the channels between the flanges 52 and 53 are appropriately spaced-apart to receive the flanges 67 of the tote box B and the margins of the cover C and the set screws 57 tightened to maintain this adjustment. The frame A is lifted underneath a shelf T and hook members 58 fitted over the lower rail 40 of a truss 37 at one side of the shelf and then the plungers 60 retracted by pulling inward on the cross rod 65 and the other side of the frame lifted to position the catch members or plungers 60 for release over the lower wire 40 of the opposite truss 37. The movement of the frame A downwardly, upwardly or endwise is prevented by abutment of the rails 40 with the beams 50 and with the hook members 58 at one end and the catch members 60 and associated structure at the other end which together form channels for receiving the rails 40. Lateral sliding of the frame A is limited by the zig-zag wires 41.

The tote box is put in place by pushing its flange 67 into the channels formed between the flanges 52 and 53 so that it rests on the flange 53. The cover plate C is put into place by locating its margins in the grooves between the respective flanges 51 and 52 and pushing it into place. It is evident that the cover need not be mounted and simplified frames provided without the intermediate flange 52 for simply mounting a tote box without the cover.

The tote box B and the cover C may be removed independently at will for filling or cleaning. The frame A can be simply taken off and removed to another position or removed entirely.

It is seen that a convenient suspending arrangement is provided for a tote box and cover. While the arrangement has been described in conjunction with a shelf of a supply cart, the arrangement is adapted to be placed on other superstructure where there are spaced-apart supporting members for receiving the hooks and catches of the supporting frame.

The invention is not limited to the materials from which the various structures described can be made. However, in a preferred construction the shelves are made of steel wire welded together at the crossing points as will be understood. The beams 50 are preferably of sheet steel and the parts welded together. Likewise, the hooks 58 are of sheet steel welded to the beam and the housing 59 and plunger 60 and other parts are also of metal appropriately welded or otherwise appropriately connected. The spring 62 may be of steel and one end welded to the plunger 60. The tote box may be of plastic or other material. The cover C may be of glass, plastic, metal or other material. Transparent glass or plastic is useful in leaving the contents of the tote box visible through the open wire shelf.

While retractable carrying members have been shown on the end of the frame A and fixed members at the other, retractable carrying members may be provided at both ends, if desired. Other variations of the structure may also be made within the principle of the invention.

I claim:

1. A mounting device for mounting a container on a superstructure having substantially horizontal spaced-apart supporting members, comprising, an open frame for suspension between the supporting members for supportably engaging the container and made up of spaced-apart beams each having a top surface, a fixed hook member mounted on the top surface adjacent one end of each beam, mounted adjacent the other end of each beam a housing in which there is slidably operable a plunger, spring means urging the plunger outward from the housing, and manipulating means on the other end of the plunger for retraction.

2. A mounting device, as defined in claim 1, in which there is also means on the frame for supportably engaging separately the margins of a cover for the container.

3. A mounting device, as defined in claim 1, in which each beam has an inwardly facing wall and three spaced-apart flanges extending inwardly from the wall providing slots for engaging flanges on the container and for engaging a cover respectively.

4. A mounting device, as defined in claim 1, in which the supportably engaging means is adjustable to different widths to accommodate containers of different sizes.

5. A mounting device, as defined in claim 1, in which there is means connecting said outer end of the respective plungers so that they may be retracted in unison.

6. A mounting device, as defined in claim 1, in which the beams are connected by straps extending inward from the respective beams and overlapping, and releasable means for holding the respective straps in fixed position relative to one another.

7. A supply device, having a frame mounting a main plurality of horizontal elongated wire shelves each equipped with spaced-apart supporting rails with access spaces above them, a hanger frame having spaced-apart beams extending between said rails, means on said beams for receiving slidably and suspending therebetween a tote box, a carrying member mounted near one end of each beam supportably engaged by one of said rails and a carrying hook member at the other end of each of said beams supportably engaged by the other rail, at least one of the carrying members on each beam being a spring held retractable plunger permitting downward removal of the frame.

8. A supply device, as defined in claim 7, in which there is means on said beams for slidably receiving and suspending therebetween a cover for the tote box.

9. A supply device, as defined in claim 7, in which there is a flange extending inwardly from each beam for engaging the flange of a tote box.

10. A supply device, as defined in claim 8, in which there is a flange extending inwardly from each beam for engaging the flange of a tote box and another flange extending inwardly from each beam for engaging the margin of a cover for the tote box.

11. A supply device, as defined in claim 7, in which the ends of the frame form with the hanger hook members a receiving channel for the supporting members limiting movement of the frame in the downward or endwise direction.

12. A supply device, as defined in claim 7, in which the ends of the frame extend beneath the hanger supporting members, and forms with the hook members stops to movement of the frame downward, upward or endwise.

13. A mounting device for mounting a container on a superstructure having substantially horizontal spaced-apart supporting members, comprising, an open frame for suspension between the supporting members for supportably engaging the container and having a pair of spaced-apart channel members having a vertically extending web and inwardly extending flange including at least a top terminal flange and another flange parallel to and spaced from it to form a ledge for receiving the edges of the container, a pair of straps extending between the respective flanges to maintain the beams in spaced-apart position, a fixed hook member near one end of each flange, a housing near the other end of each flange, a plunger in each housing having a nose projecting therefrom, spring means within the mounting normally urging the plunger outwards to place the nose in an operative position and permitting it to be withdrawn, and a cross bar connecting the respective plungers whereby they may be withdrawn in unison.

14. A mounting device, as claimed in claim 13, in which said cross bars each have a channel connected to one channel member and a strap connected to the other and slidable in the channel, said channel being provided with a slot and a screw extending through said slot to engage a threaded opening in said strap whereby the width of the mounting device can be adjusted.

15. A mounting device, as defined in claim 13, in which there are a pair of inward flanges spaced from said top flange to form ledges receiving the edge of a tote box with a cover for the tote box respectively.

* * * * *